US006092697A

United States Patent [19]

Weaver et al.

[11] Patent Number: 6,092,697

[45] Date of Patent: Jul. 25, 2000

[54] TWO CHAMBERED SPRAY CAN

[76] Inventors: Frank S. Weaver, 1447 Touhy Ave., Apt. 406, Chicago, Ill. 60626; James J. Wolak, 3020 W. 31st St., Oak Brook, Ill. 60523

[21] Appl. No.: 09/156,118

[22] Filed: Sep. 17, 1998

[51] Int. Cl.[7] ..... B65D 83/00

[52] U.S. Cl. ..... 222/402.18; 222/635

[58] Field of Search ..... 222/402.1, 145.4, 222/402.18, 635, 136

[56] References Cited

U.S. PATENT DOCUMENTS

| | | | |
|---|---|---|---|
| 3,401,844 | 9/1968 | Hanson, Jr. | 222/635 |
| 3,420,415 | 1/1969 | Kuffer | 222/402.18 |
| 3,425,600 | 2/1969 | Abplanalp | 222/635 |
| 3,685,695 | 8/1972 | Yuhas | 222/402.1 |

*Primary Examiner*—Philippe Derakshani

[57] ABSTRACT

A new two chambered spray can for separating propellants from main contents of the can. The inventive device includes a cylindrical can having an interior holding chamber disposed therein extending downwardly from a top end thereof. A valve assembly is slidably disposed within the top end of the cylindrical can. The valve assembly includes a central passage and a pair of outer passages each having upper ends in fluid communication with the central passage. Each of the outer passages extend downwardly with inlets in communication with the interior holding chamber. A central tube is in fluid communication with the branched inlet ends of the central passage and extend outwardly of the interior holding chamber with the central tube being in fluid communication with the cylindrical can.

4 Claims, 3 Drawing Sheets

TWO CHAMBERED SPRAY CAN

BACKGROUND OF THE INVENTION

1. Field of the Invention

The present invention relates to aerosol dispensers and more particularly pertains to a new two chambered spray can for separating propellants from main contents of the can.

2. Description of the Prior Art

The use of aerosol dispensers is known in the prior art. More specifically, aerosol dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art aerosol dispensers include U.S. Pat. No. 5,143,288 to Kohler et al.; U.S. Pat. No. 3,869,070 to Schmoegner et al.; U.S. Pat. No. 3,624,793 to Marand; U.S. Pat. No. 5,337,929 to Van Der Heijden; U.S. Pat. No. 3,420,415 to Kuffer; and U.S. Pat. No. 4,061,252 to Riccio.

While these devices fulfill their respective, particular objectives and requirements, the aforementioned patents do not disclose a new two chambered spray can. The inventive device includes a cylindrical can having an interior holding chamber disposed therein extending downwardly from a top end thereof. A valve assembly is slidably disposed within the top end of the cylindrical can. The valve assembly includes a central passage and a pair of outer passages each having upper ends in fluid communication with the central passage. Each of the outer passages extend downwardly with inlets in communication with the interior holding chamber. A central tube is in fluid communication with the branched inlet ends of the central passage and extend outwardly of the interior holding chamber with the central tube being in fluid communication with the cylindrical can.

In these respects, the two chambered spray can according to the present invention substantially departs from the conventional concepts and designs of the prior art, and in so doing provides an apparatus primarily developed for the purpose of separating propellants from main contents of the can.

SUMMARY OF THE INVENTION

In view of the foregoing disadvantages inherent in the known types of aerosol dispensers now present in the prior art, the present invention provides a new two chambered spray can construction wherein the same can be utilized for separating propellants from main contents of the can.

The general purpose of the present invention, which will be described subsequently in greater detail, is to provide a new two chambered spray can apparatus and method which has many of the advantages of the aerosol dispensers mentioned heretofore and many novel features that result in a new two chambered spray can which is not anticipated, rendered obvious, suggested, or even implied by any of the prior art aerosol dispensers, either alone or in any combination thereof.

To attain this, the present invention generally comprises a cylindrical can having a top end, a bottom end and a cylindrical side wall therebetween. The cylindrical can includes an interior holding chamber disposed therein extending downwardly from the top end thereof. A valve assembly is slidably disposed within the top end of the cylindrical can. The valve assembly includes an upper portion disposed within the top end. The valve assembly includes a lower T-shaped portion integrally formed with a lower end of the upper portion. The lower T-shaped portion has a spring positioned thereon. The spring serves to bias the valve assembly upwardly. The valve assembly includes an actuator cap secured to an upper end of the upper portion disposed outwardly of the cylindrical can. The valve assembly includes a central passage. The central passage has an outlet extending outwardly of the actuator cap. The central passage extends downwardly through the upper portion and extends outwardly of the lower T-shaped portion in branched inlet ends. A pair of outer passages each have upper ends in fluid communication with the outlet of the central passage. Each of the outer passages extend downwardly with inlets in communication with the interior holding chamber. A central tube having an upper end is secured to a lower end of the lower T-shaped portion of the valve assembly. Tile central tube is in fluid communication with the branched inlet ends of the central passage. The central tube has a beveled lower end extending outwardly of the interior holding chamber with the central tube in fluid communication with the cylindrical can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new two chambered spray can apparatus and method which has many of the advantages of the aerosol dispensers mentioned heretofore and many novel features that result in a new two chambered spray can which is not anticipated, rendered obvious, suggested, or even implied by any of the prior art aerosol dispensers, either alone or in any combination thereof.

It is another object of the present invention to provide a new two chambered spray can which may be easily and efficiently manufactured and marketed.

It is a further object of the present invention to provide a new two chambered spray can which is of a durable and reliable construction.

An even further object of the present invention is to provide a new two chambered spray can which is susceptible of a low cost of manufacture with regard to both materials and labor, and which accordingly is then susceptible of low prices of sale to the consuming public, thereby making such two chambered spray can economically available to the buying public.

Still yet another object of the present invention is to provide a new two chambered spray can which provides in the apparatuses and methods of the prior art sonic of the advantages thereof, while simultaneously overcoming some of the disadvantages normally associated therewith.

Still another object of the present invention is to provide a new two chambered spray can for separating propellants from main contents of the can.

Yet another object of the present invention is to provide a new two chambered spray can which includes a cylindrical can having an interior holding chamber disposed therein extending downwardly from a top end thereof. A valve assembly is slidably disposed within the top end of the cylindrical can. The valve assembly includes a central passage and a pair of outer passages each having upper ends in fluid communication with the central passage. Each of the outer passages extend downwardly with inlets in communication with the interior holding chamber. A central tube is in fluid communication with the branched inlet ends of the central passage and extend outwardly of the interior holding chamber with the central tube being in fluid communication with the cylindrical can.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
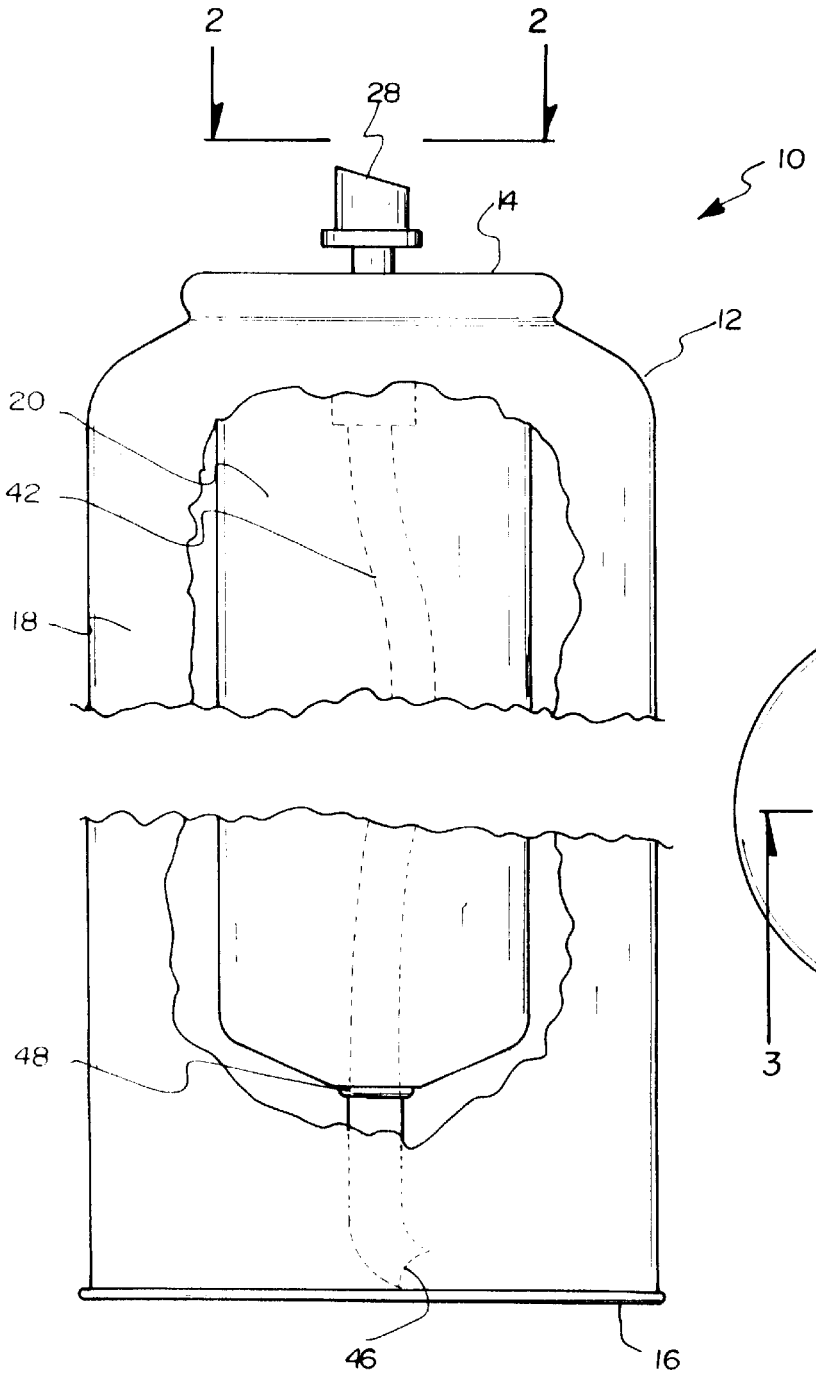
FIG. 1 is a front view of a new two chambered spray can according to the present invention.
Figure 2:
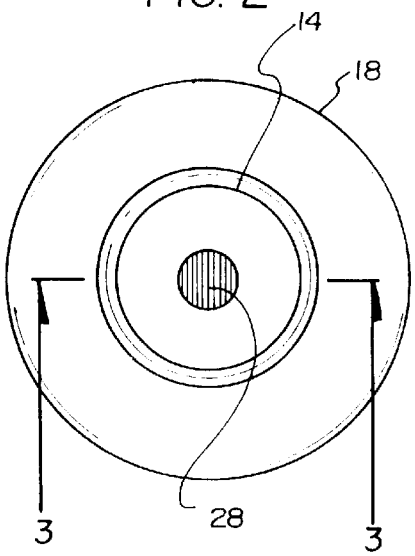
FIG. 2 is a top plan view of the present invention as taken along line 2—2 of FIG. 1.
Figure 4:
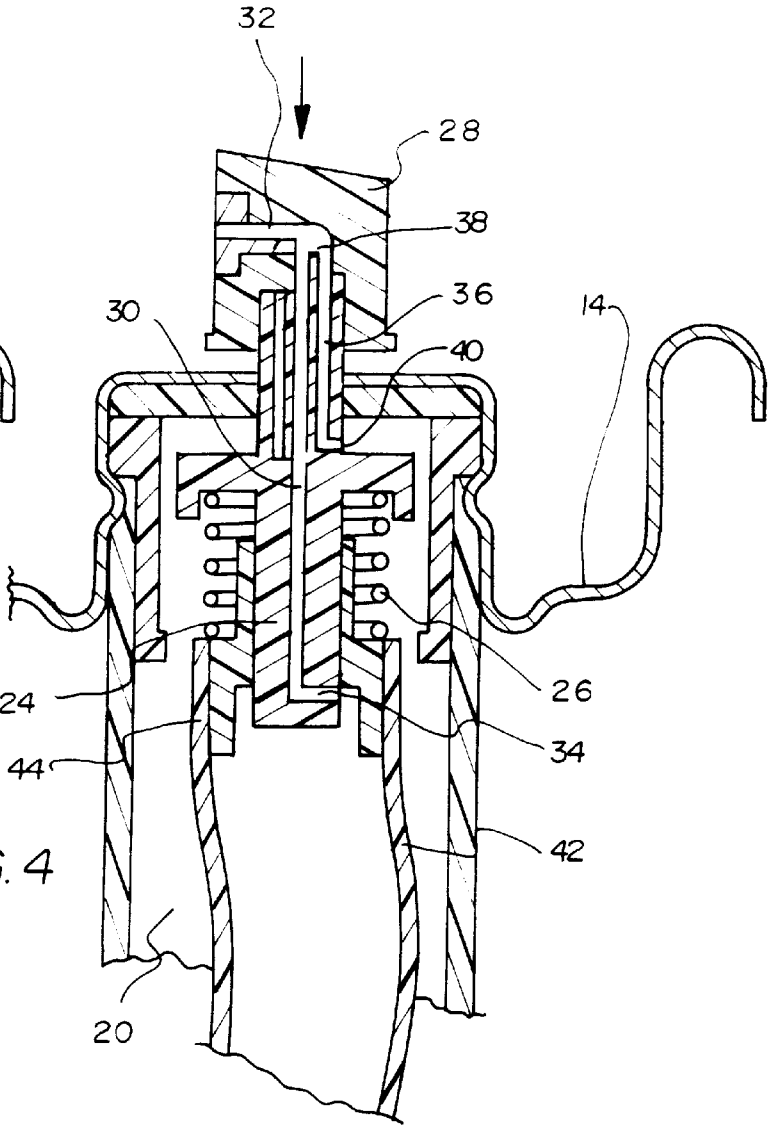
FIG. 4 is a cross-sectional view of the present invention shown with the actuator button depressed.
Figure 3:
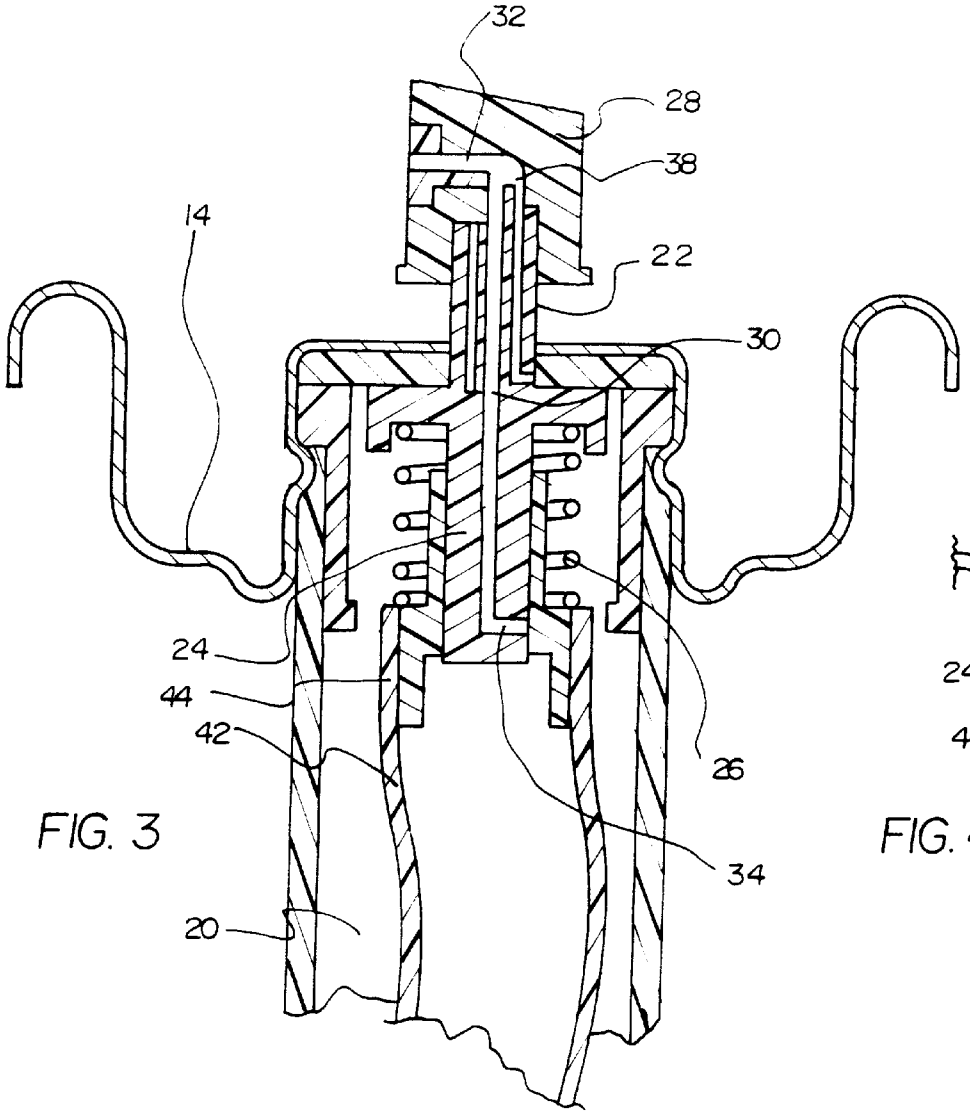
FIG. 3 is a cross-sectional view of the present invention as taken along line 3—3 of FIG. 2.
Figure 6:
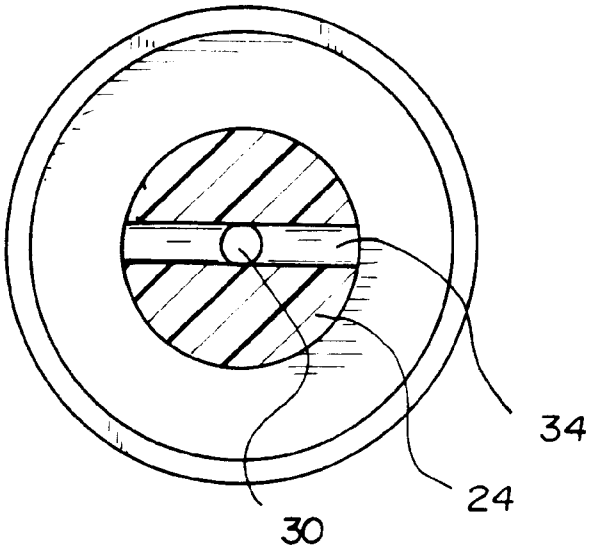
FIG. 6 is a cross-sectional view of the present invention as taken along line 6—6 of FIG. 5.
Figure 5:
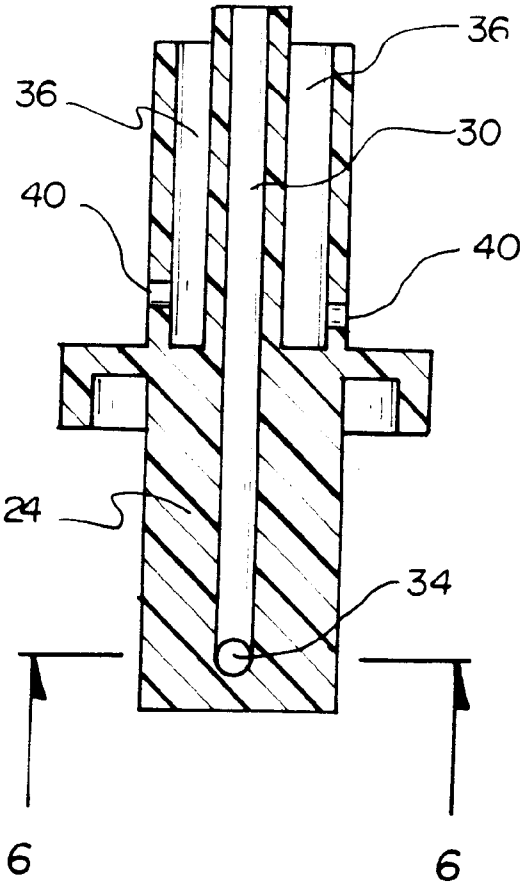
FIG. 5 is a cross-sectional view of the T-shaped collar of the present invention.

With reference now to the drawings, and in particular to FIGS. 1 through 6 thereof, a new two chambered spray can embodying the principles and concepts of the present invention and generally designated by the reference numeral 10 will be described.

As best illustrated in FIGS. 1 through 6, the two chambered spray can 10 comprises a cylindrical can 12 having a top end 14, a bottom end 16 and a cylindrical side wall 18 therebetween. The cylindrical can 12 includes an interior holding chamber 20 disposed therein extending downwardly from the top end thereof. The can 12 is designed similarly to the industry standards.

A valve assembly is slidably disposed within the top end 14 of the cylindrical can 12. The valve assembly includes an upper portion 22 disposed within the top end 14. The valve assembly includes a lower T-shaped portion 24 integrally formed with a lower end of the upper portion 22. The lower T-shaped portion 24 has a spring 26 positioned thereon. The spring 26 serves to bias the valve assembly upwardly. The valve assembly includes an actuator cap 28 secured to an upper end of the upper portion 22 disposed outwardly of the cylindrical can 12. The valve assembly includes a central passage 30. The central passage 30 has an outlet 32 extending outwardly of the actuator cap 28. The central passage 30 extends downwardly through the upper portion 22 and extends outwardly of the lower T-shaped portion 24 in branched inlet ends 34. A pair of outer passages 36 each have upper ends 38 in fluid communication with the outlet 32 of the central passage 30. Each of the outer passages 36 extend downwardly with inlets 40 in communication with the interior holding chamber 20.

A central tube 42 having an upper end 44 is secured to a lower end of the lower T-shaped portion 24 of the valve assembly. The central tube 42 is in fluid communication with the branched inlet ends 34 of the central passage 30. The central tube 42 has a beveled lower end 46 extending outwardly of the interior holding chamber 20 with the central tube 42 in fluid communication with the main contents of the cylindrical can 12. A sealing member 48 is also provided to tightly seal the interior holding camber 20 with respect to the cylindrical can 12.

In use, the propellant can be stored within either the cylindrical can 12 or the interior holding chamber 20 with the main contents of the can 12 preferably stored in the opposing portion. This will separate the propellant from the contents. This will allow materials otherwise unable to be incorporated into an aerosol can because they couldn't be mixed with a propellant to now be used with this device 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A two chambered spray can for separating a propellant from main contents of the can comprising, in combination:

a cylindrical can having a top end, a bottom end and a cylindrical side wall therebetween, the cylindrical can including an interior holding chamber disposed therein extending downwardly from the top end thereof;

a valve assembly slidably disposed within the top end of the cylindrical can, the valve assembly including an upper portion disposed within the top end, the valve assembly including a lower T-shaped portion integrally formed with a lower end of the upper portion, the lower T-shaped portion having a spring positioned thereon, the spring serving to bias the valve assembly upwardly, the valve assembly including an actuator cap secured to an upper end of the upper portion disposed outwardly of the cylindrical can, the valve assembly including a central passage, the central passage having an outlet extending outwardly of the actuator cap, the central passage extending downwardly through the upper portion and extending outwardly of the lower T-shaped portion in branched inlet ends, a pair of outer passages each having upper ends in fluid communication with the outlet of the central passage, each of the outer passages extending downwardly with inlets in communication with the interior holding chamber; and a central tube having an upper end secured to a lower end of the lower T-shaped portion of the valve assembly, the central tube being in fluid communication with the branched inlet ends of the central passage, the central tube having a beveled lower end extending outwardly of the interior holding chamber with the central tube being in fluid communication with the cylindrical can.

2. A two chambered spray can comprising:

a cylindrical can including an interior holding chamber disposed therein extending downwardly from a top end thereof;

a valve assembly slidably disposed within the top end of the cylindrical can, the valve assembly including a central passage and a pair of outer passages each having upper ends in fluid communication with the central passage, each of the outer passages extending downwardly with inlets in communication with the interior holding chamber; and a central tube being in fluid communication with the branched inlet ends of the central passage and extending outwardly of the interior holding chamber with the central tube being in fluid communication with the cylindrical can.

3. The two chambered spray can as set forth in claim 2 wherein the central tube has a beveled lower end.

4. The two chambered spray can as set forth in claim 2 wherein the valve assembly includes an upper portion disposed within the top end, the valve assembly includes a lower T-shaped portion integrally formed with a lower end of the upper portion, the lower T-shaped portion having a spring positioned thereon, the spring serving to bias the valve assembly upwardly, the valve assembly including an actuator cap secured to an upper end of the upper portion disposed outwardly of the cylindrical can, the central passage having an outlet extending outwardly of the actuator cap.

* * * * *